US010486319B2

(12) United States Patent
Provost et al.

(10) Patent No.: US 10,486,319 B2
(45) Date of Patent: Nov. 26, 2019

(54) SHAVING SYSTEM

(71) Applicant: SHAVELOGIC, INC., Dallas, TX (US)

(72) Inventors: Craig A. Provost, Boston, MA (US); William E. Tucker, Attleboro, MA (US); John W. Griffin, Moultonborough, NH (US)

(73) Assignee: SHAVELOGIC, INC., Dallas, TX (US)

( * ) Notice: Subject to any disclaimer, the term of this patent is extended or adjusted under 35 U.S.C. 154(b) by 198 days.

(21) Appl. No.: 14/948,688

(22) Filed: Nov. 23, 2015

(65) Prior Publication Data

US 2016/0075041 A1 Mar. 17, 2016

Related U.S. Application Data

(63) Continuation of application No. PCT/US2014/043312, filed on Jun. 20, 2014.

(60) Provisional application No. 61/840,267, filed on Jun. 27, 2013.

(51) Int. Cl.
*B26B 21/40* (2006.01)
*A45D 24/36* (2006.01)

(52) U.S. Cl.
CPC ..... *B26B 21/4012* (2013.01); *A45D 24/36* (2013.01); *B26B 21/40* (2013.01); *B26B 21/4081* (2013.01)

(58) Field of Classification Search
CPC . B26B 21/4081; B26B 21/4012; B26B 21/40; A45D 24/36
USPC ..... 30/537–541, 32–43.3, 47–84; 132/214–215
See application file for complete search history.

(56) References Cited

U.S. PATENT DOCUMENTS 1,442,359 A * 1/1923 Posnick ..... A45D 24/36 132/214
2,579,664 A * 12/1951 Gleasman ..... G01B 3/04 33/39.2
2,866,984 A * 1/1959 Plough ..... B26B 21/12 30/278
3,134,382 A * 5/1964 Broman ..... A45D 24/36 132/213.1
3,820,543 A * 6/1974 Vanjushin ..... A61B 17/322 30/394
5,461,795 A * 10/1995 Kok ..... B29C 45/16 33/483

(Continued)

FOREIGN PATENT DOCUMENTS

WO WO-2012033362 A2 * 3/2012 ..... B26B 21/18

OTHER PUBLICATIONS

International Search Report—Corresponding PCT Application No. PCT/US2014/043312, dated Oct. 14, 2014, 3 pages.

*Primary Examiner* — Kenneth E Peterson
*Assistant Examiner* — Nhat Chieu Q Do
(74) *Attorney, Agent, or Firm* — Leber IP Law; Celia H. Leber

(57) ABSTRACT

Shaving systems are disclosed that include (a) a handle having a distal end and a proximal end; and (b) a shaving assembly, disposed at the distal end of the handle, the shaving assembly including a blade unit comprising a plurality of blades disposed in a housing, the housing having a front cutting side and an opposite rear side and a plurality of measurement elements on a trailing edge of the rear side.

7 Claims, 14 Drawing Sheets

(56) References Cited

U.S. PATENT DOCUMENTS

| | | | | |
|---|---|---|---|---|
| 5,487,223 | A * | 1/1996 | Krane | G01B 3/004 33/483 |
| 5,908,036 | A * | 6/1999 | Andrews | A45D 24/36 132/215 |
| 6,164,290 | A * | 12/2000 | Andrews | A45D 24/36 132/215 |
| 6,311,400 | B1 * | 11/2001 | Hawes | B26B 21/225 30/50 |
| 8,739,411 | B2 * | 6/2014 | Kinghorn | B26B 21/42 30/30 |
| 8,806,758 | B2 * | 8/2014 | Pineda | B26B 21/10 30/30 |
| 2004/0074511 | A1 | 4/2004 | Sussan | |
| 2007/0089578 | A1 | 4/2007 | Zoot | |
| 2007/0261709 | A1 | 11/2007 | Bakus | |
| 2009/0235539 | A1 | 9/2009 | Wonderley | |
| 2011/0126413 | A1 | 6/2011 | Szczepanowski et al. | |
| 2013/0000127 | A1 * | 1/2013 | Coresh | B26B 21/22 30/41 |
| 2013/0081274 | A1 * | 4/2013 | Wain | B26B 21/4018 30/34.2 |
| 2013/0081289 | A1 * | 4/2013 | Wain | B26B 21/52 30/527 |

* cited by examiner

SHAVING SYSTEM

RELATED APPLICATION

This application is a continuation application of PCT Application Ser. No. PCT/US2014/043312, filed Jun. 20, 2014, which claims priority to U.S. Provisional Application Ser. No. 61/840,267, filed Jun. 27, 2013. The complete disclosures of these applications are hereby incorporated by reference herein.

BACKGROUND

The invention relates to shaving systems having handles and blade units. The blade units typically have one or more blades mounted in a housing. After the blades in a blade unit have become dull from use, the shaving system is discarded and replaced. Modular blade unit design allows for replacement of only the blade unit enabling reuse of the handle.

Shaping and sculpting facial and body hair features has long been used to enhance and distinguish an individual's identity. Over the last 10 years, the use of facial hair sculpting as identity branding by individuals has seen a massive increase. However, there has never been a simple system that a user could reference to consistently achieve excellent results.

SUMMARY

Embodiments of the present invention generally provide a shaving system including a handle, a blade unit, and measurement features provided on the housing of the blade unit.

In one aspect, the invention features a shaving system comprising a handle having a distal end and a proximal end; and a shaving assembly, disposed at the distal end of the handle, the shaving assembly including a blade unit comprising a plurality of blades disposed in a housing, the housing having a front cutting side, an opposite rear side, and a plurality of measurement elements on the housing, e.g., on the trailing edge of the rear side.

Some implementations include one or more of the following features.

The neasurement elements may be spaced in a graduated manner along the trailing edge from a first lateral side of the housing to a second lateral side of the housing.

The blade unit may further include a lubricating strip disposed adjacent the trailing edge on the cutting side of the housing, and the measurement elements may include openings positioned so that portions of the lubricating strip are visible through the openings.

Some embodiments of the shaving system further comprise a plurality of evenly spaced hash marks between the measurement elements.

In some cases, at least portions of the measurement elements are a different color than the housing.

Portions of the measurement elements may be raised, e.g., may include raised areas of housing, such as raised arrows, triangles or dots. In some cases the raised portions are pad printed.

The measurement elements of the shaving system may comprise openings that are arrow shaped or triangular, or, alternatively, the measurement elements may comprise openings that define a triangular or arrow-shaped portion of the housing.

In some implementations the blade unit further comprises a strip of material mounted on the housing and the measurement elements are provided on the strip, e.g., as graduated markings on the strip. In some cases, the strip is metal and the markings are etched on the strip.

In some implementations the shaving assembly is removably connected to the handle by an interface element. In some cases, a pivoting connection is provided between the blade unit and the interface element.

In another aspect, the invention features a method of shaving comprising contacting the skin with the blade unit of a shaving system the blade unit comprising a plurality of blades disposed in a housing, the housing having a front cutting side and an opposite rear side, and a plurality of measurement elements on a trailing edge of the rear side of the housing.

Some implementations of this aspect of the invention include one or more of the following features. The method may include utilizing the measurement elements to dimension an area that is not to be shaved. Alternatively, or in addition, the method may include utilizing the measurement elements to measure a facial hair feature, for example a mustache, a pair of sideburns or a beard. In some cases, the facial hair feature has two sides and the measurement elements are used to ensure that the two sides have substantially the same dimensions.

DETAILED DESCRIPTION

Figure 1A:
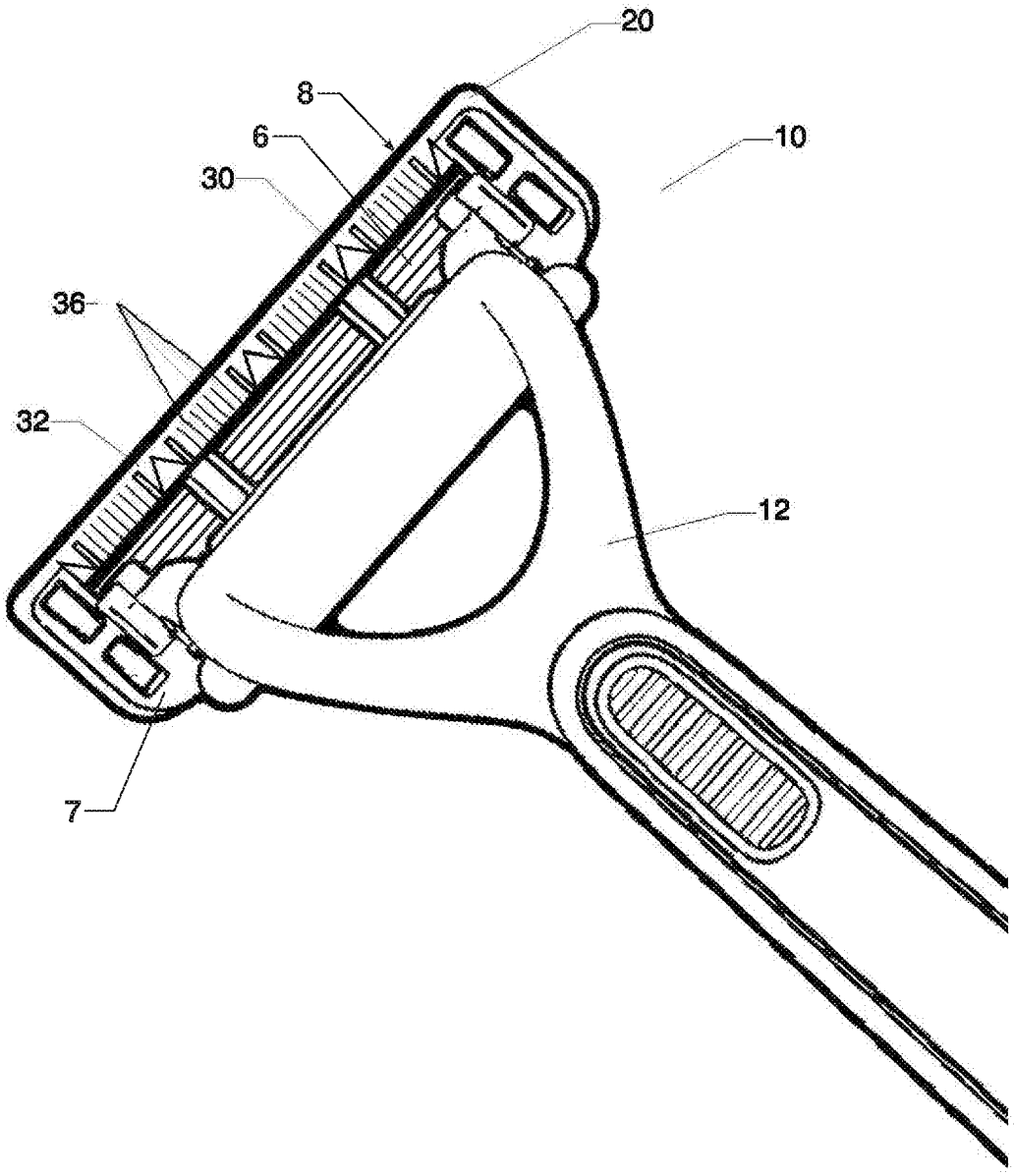
FIG. 1A is a perspective view of the device.
Figure 2:
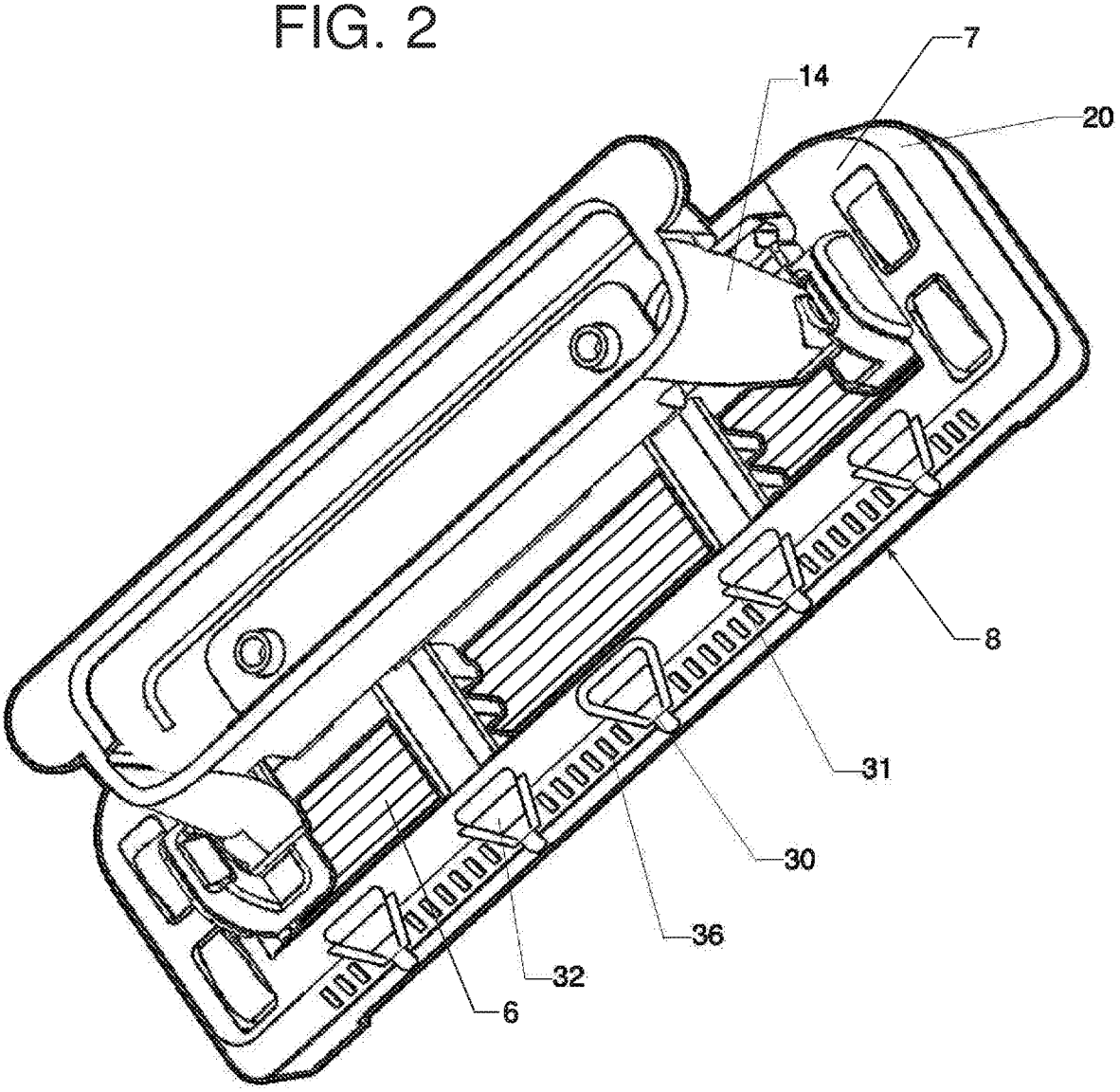
FIG. 2 is a perspective view of the shaving system according to one embodiment.
Figure 3:
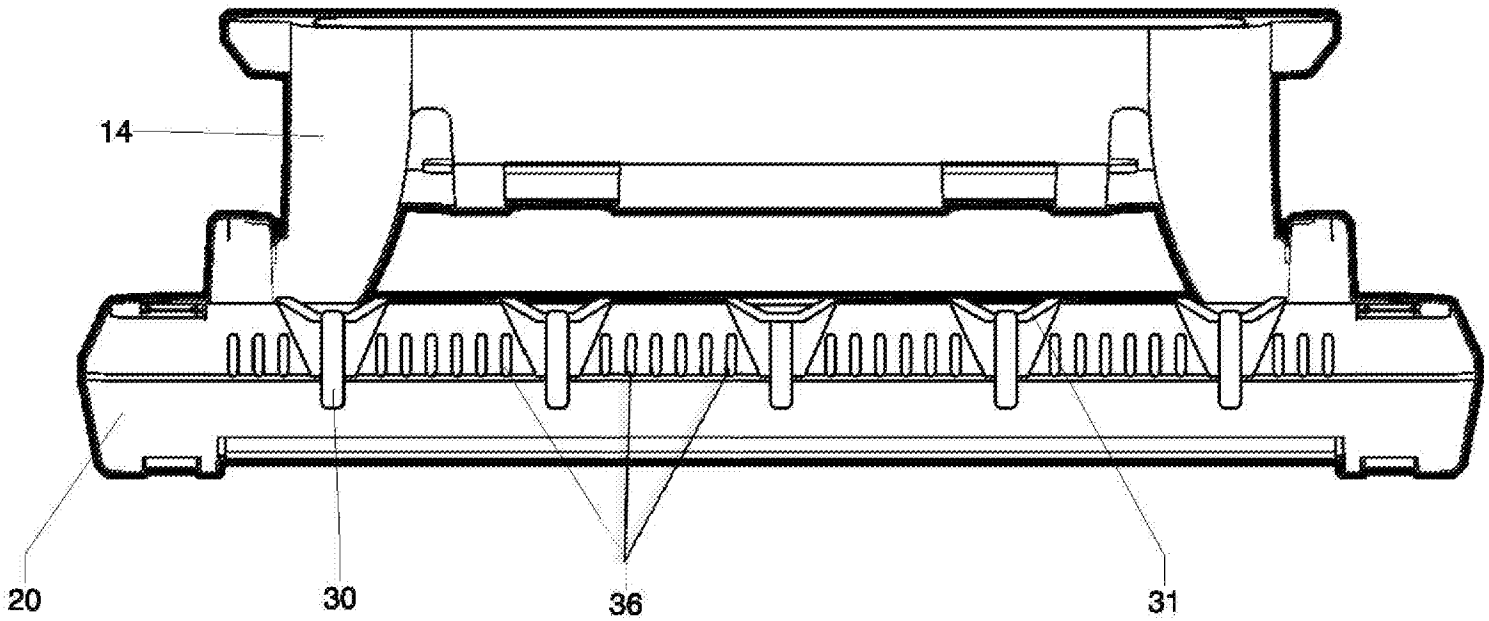
FIG. 3 is a front view of the shaving system.
Figure 4:
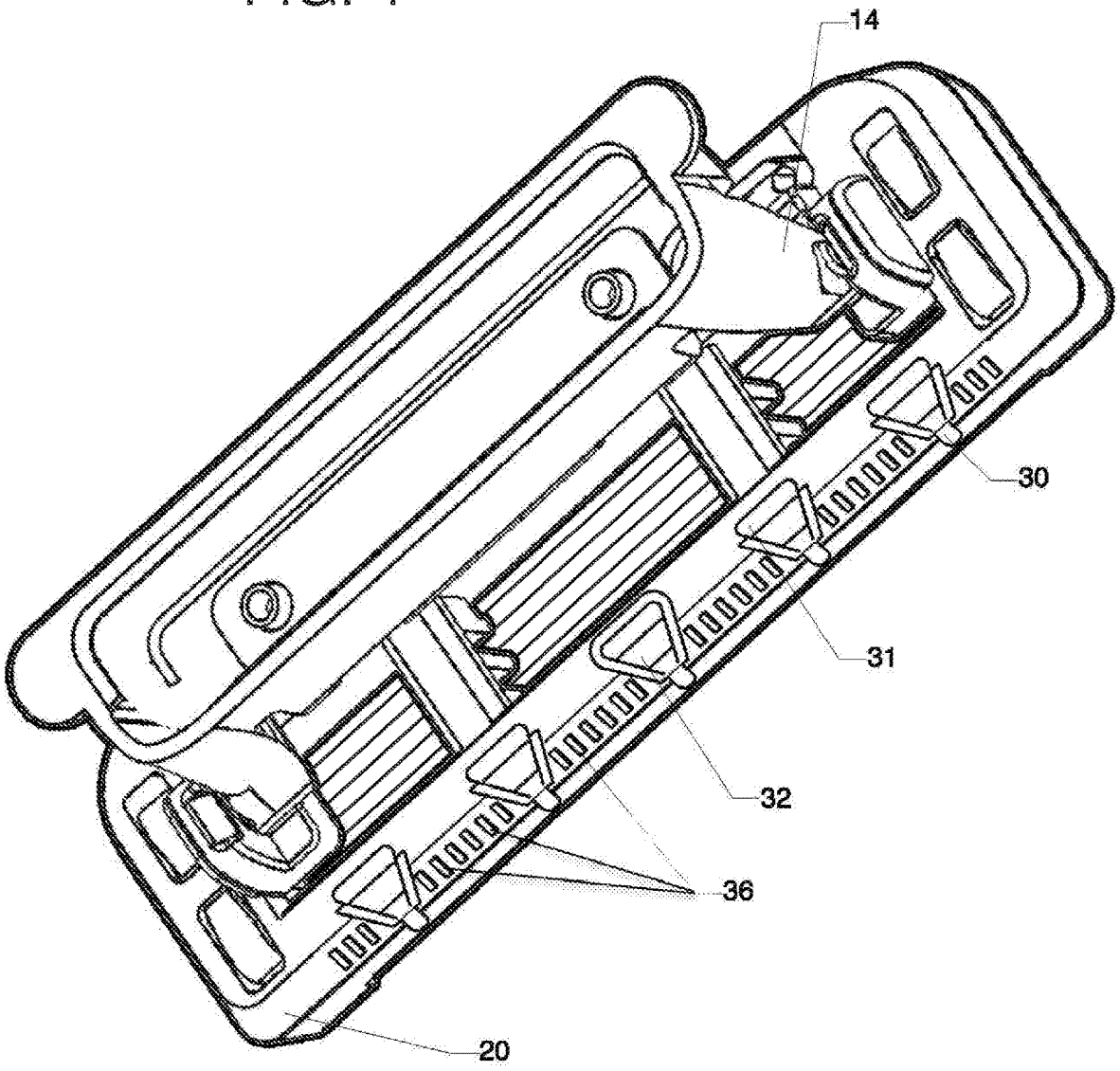
FIG. 4 is a perspective view of an alternative embodiment.
Figure 5:
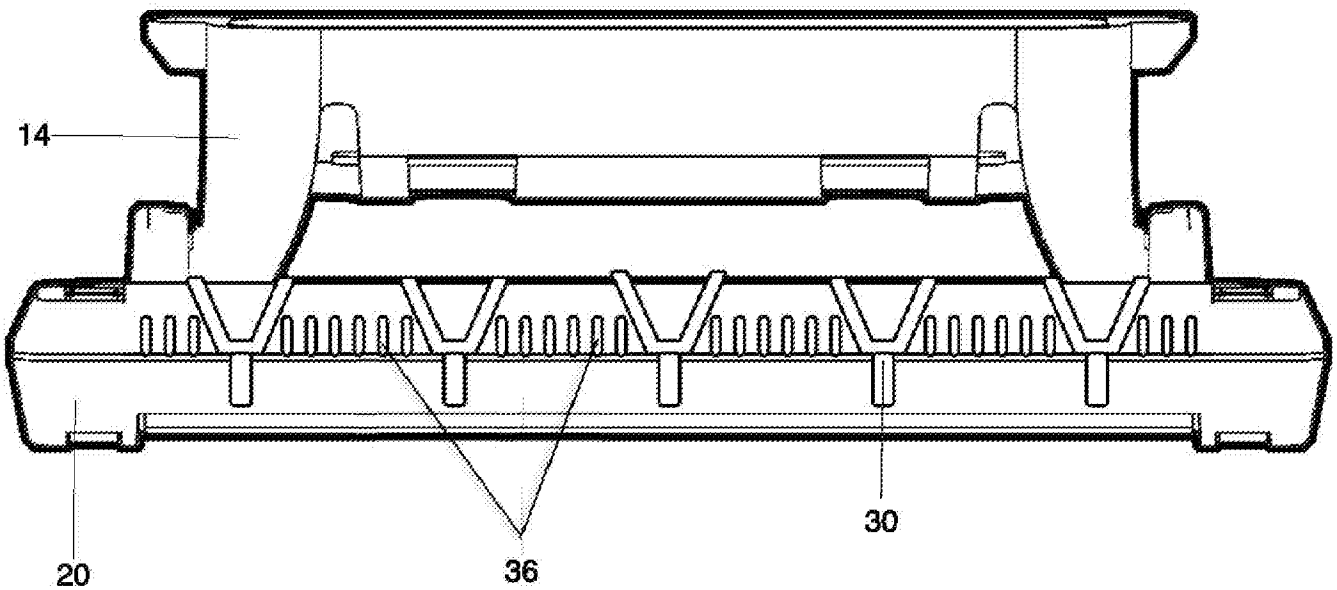
FIG. 5 is a front view of the alternative embodiment.
Figure 6:
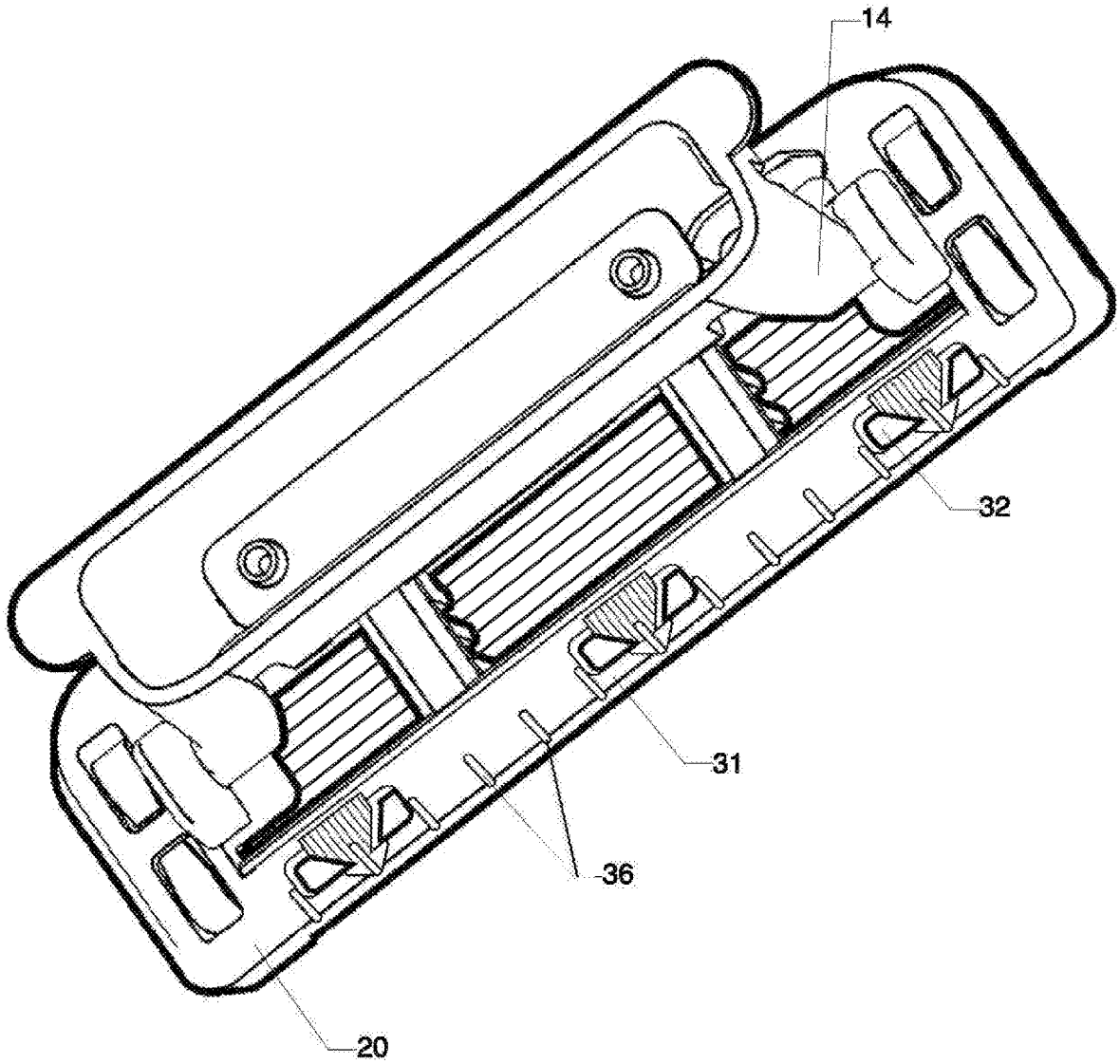
FIG. 6 is a perspective view of a second alternative embodiment.
Figure 7:
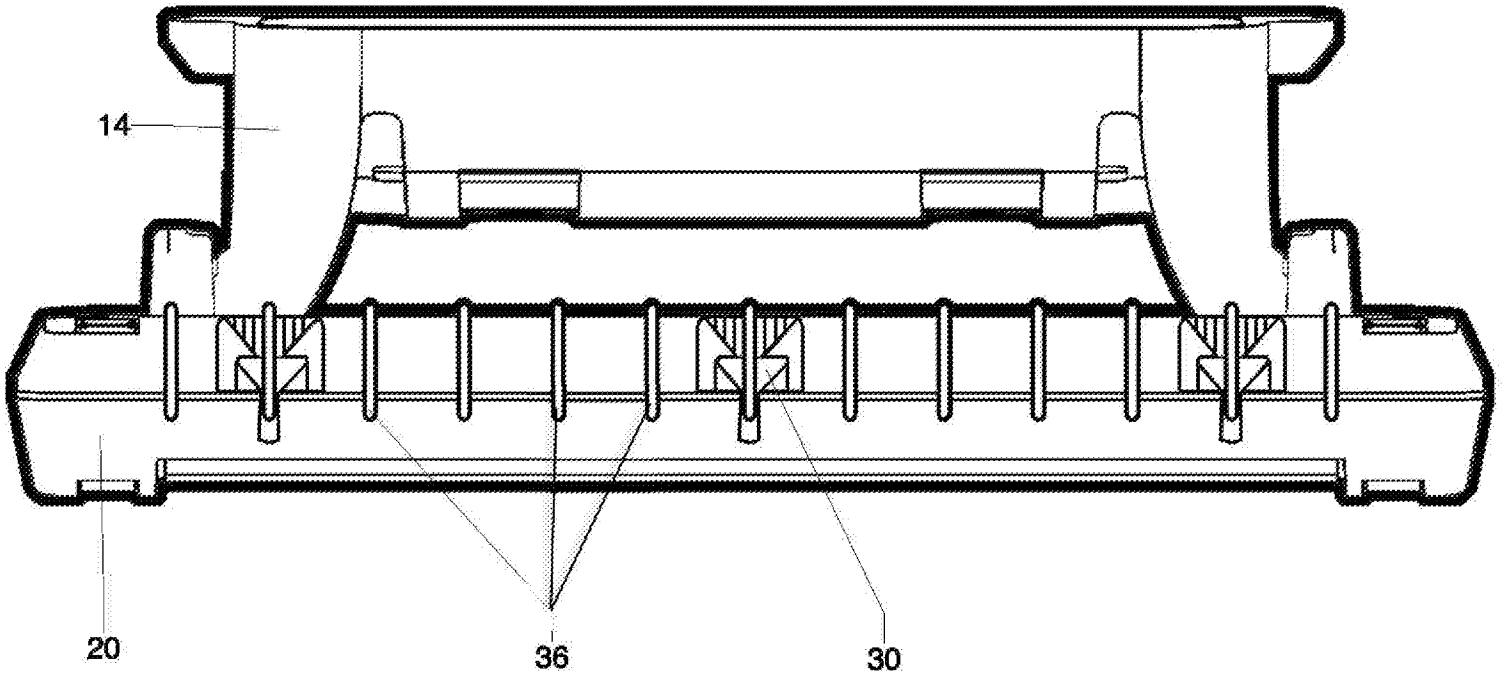
FIG. 7 is front view of the second alternative embodiment.
Figure 8:
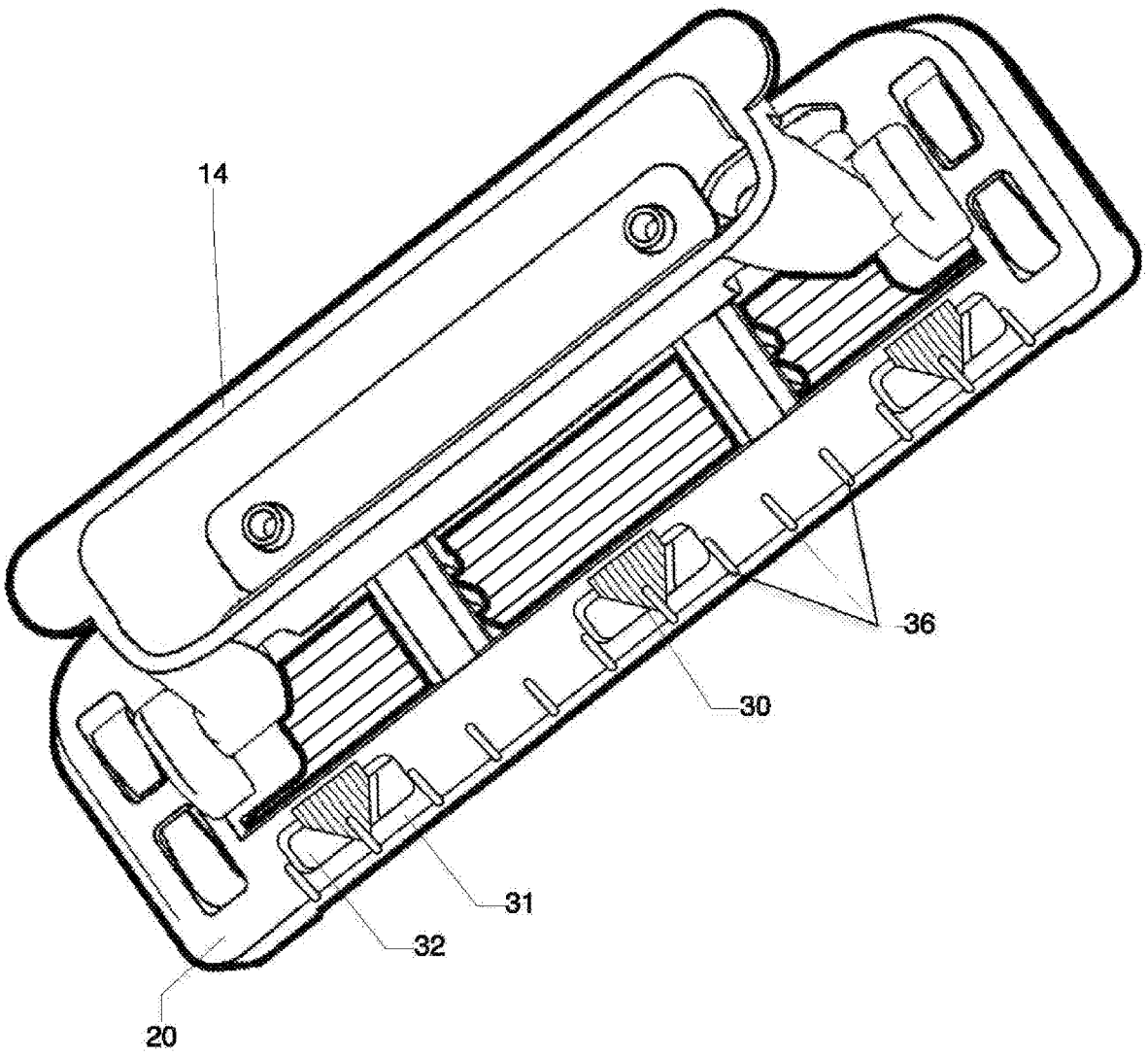
FIG. 8 is a perspective view of a third alternative embodiment.
Figure 9:
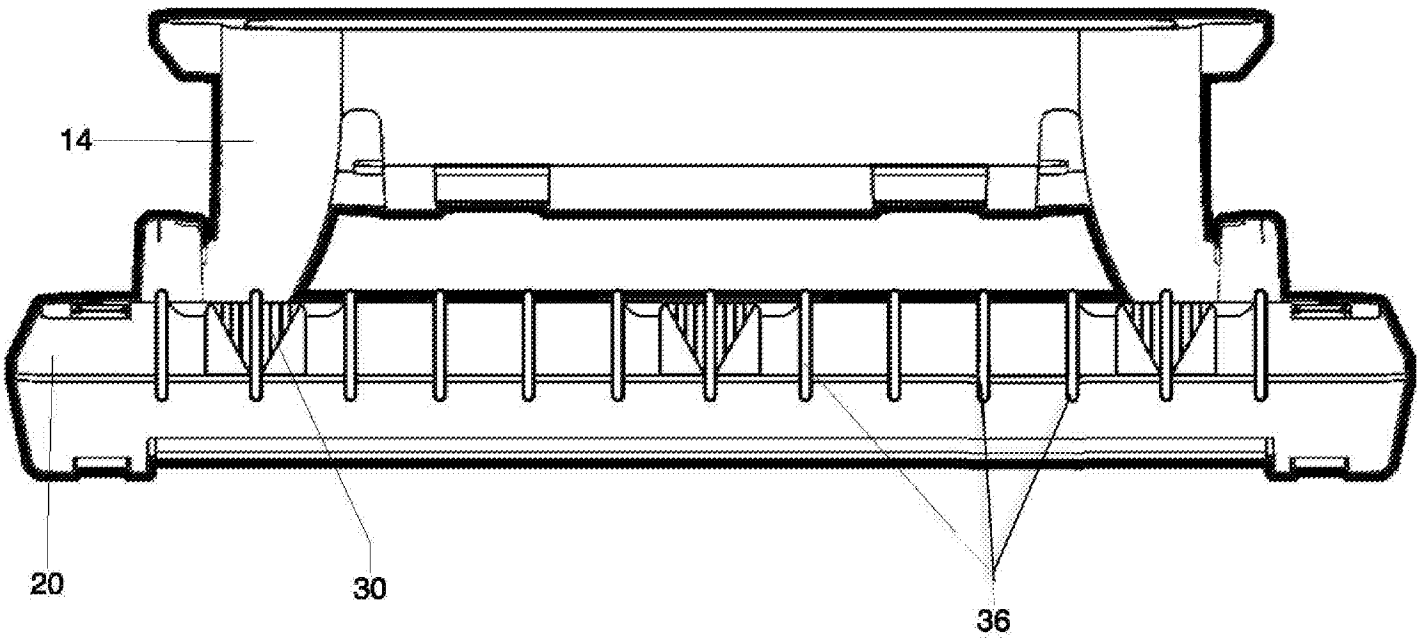
FIG. 9 is a front view of the third alternative embodiment.

The present disclosure relates generally to consumer products and, in particular, to shaving systems. In one embodiment, the present disclosure features a consumer product system having a handle 12 and a blade unit 20 mounted on the handle. Referring to FIGS. 1A and 2, the blade unit 20 comprises a housing that contains a plurality of blades 6, the edges of which are exposed on the bottom surface of the blade unit (the surface that contacts the user's skin during shaving). The opposite surface 7, or top, of the housing includes a plurality of measurement elements 30, which are positioned along a trailing edge 8 of the housing and are configured to assist the user in obtaining a precise shave, as will be discussed further below.

Figure 1:
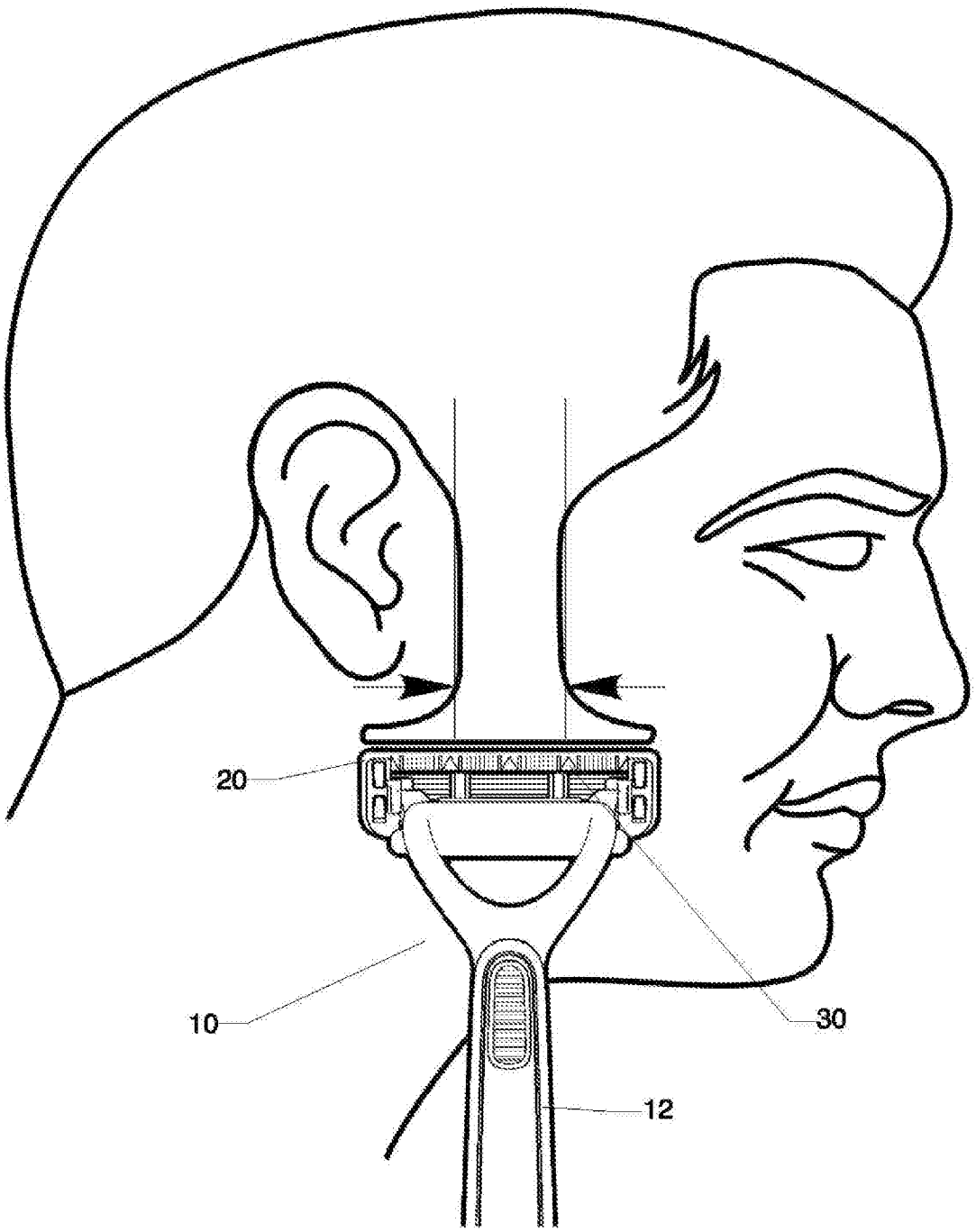
FIG. 1 is a profile view of the device.

Referring to FIG. 1, the handle 12 provides a manner in which the shaving system 10 can be manipulated and leverage can be applied to achieve desired shaving results.

Measurement elements 30 are positioned on the top surface of the blade unit 20 that is visible to the user during shaving, in a measured manner to allow the user to reference them while shaving. The measurement elements 30 provide a means for the user to more precisely gauge where to utilize the shaving system 10 when sculpting facial and body hair features, e.g. mustache, side burns, etc. For example, the measurement elements 30, as well as the evenly spaced ruled lines 36 between the measurement elements (FIG. 1A), allow the user to easily determine whether opposite side burns or opposite sides of a mustache are even or whether one side or the other requires further trimming. As shown in FIG. 1, during shaving the user can use the measurement elements 30 to measure the width of a facial hair feature (e.g., a sideburn as shown) and then compare that measurement to the width measured on the opposite side of the user's face.

Referring to FIGS. 1 and 1A, in one embodiment the measurement elements 30 are etched on a strip 32 that is inserted in the top edge of the rear side of the housing of blade unit 20. In this embodiment, the strip 32 may be metal or plastic. The measurement elements may be molded, etched, painted, or applied by any suitable technique. The measurement elements may be enhanced with color to allow for easy identification. The coloration of the measurement elements 30 could be accomplished by using a coating, e.g. PVD coating, plating, decoration, or another technique.

Figure 10:
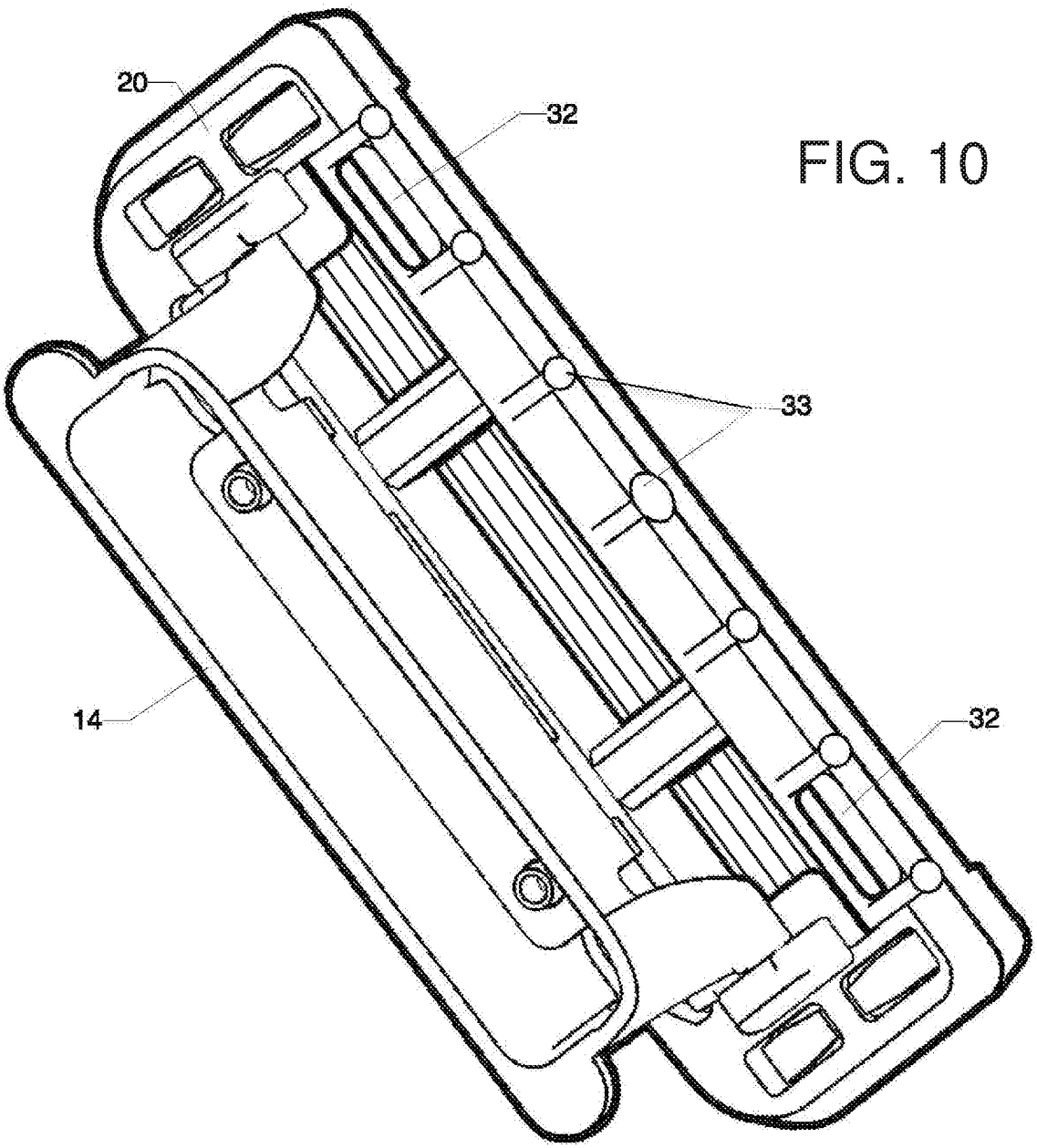
FIG. 10 is a perspective view of a fourth alternative embodiment.
Figure 11:
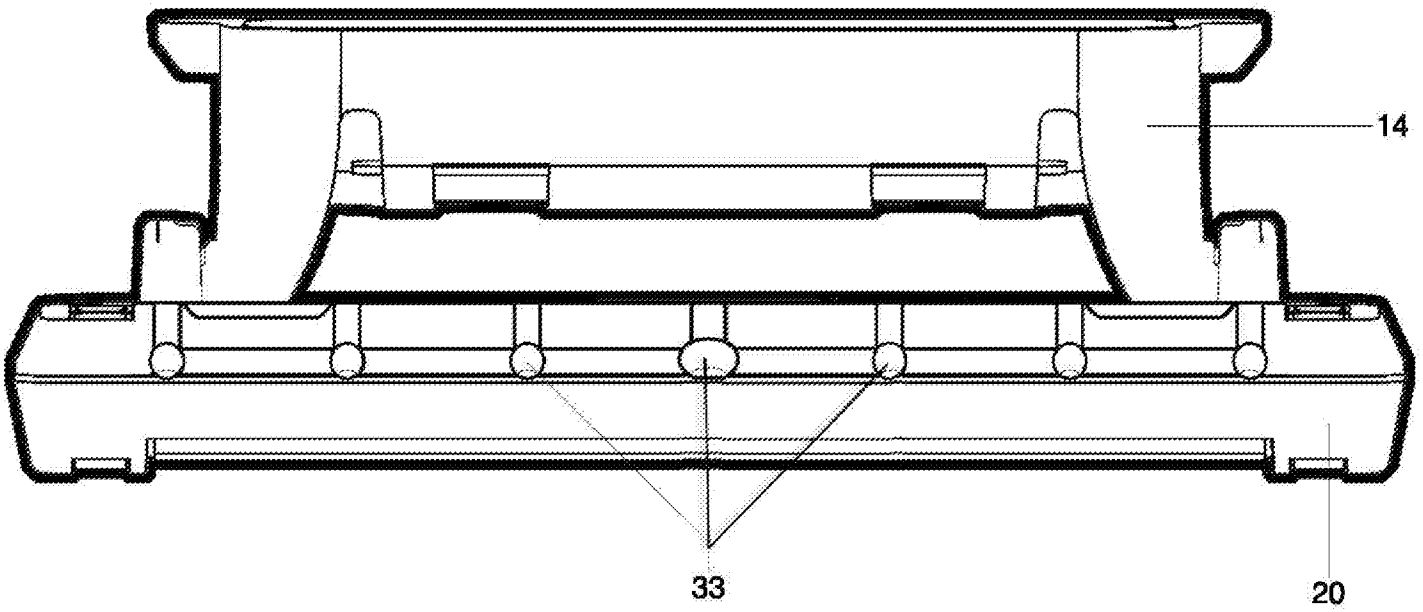
FIG. 11 is a front view of the fourth alternative embodiment.

Referring to FIGS. 2-5, in other embodiments, the measurement elements 30 can be integrally formed with the housing of the blade unit 20. Additionally, the measurement elements 30 can protrude from the top and/or right surface of the blade unit 20. For example, the measurement elements 30 may be in the form of a raised rim surrounding a triangular measurement element aperture 31,. Alternatively, the measurement elements 30 may be formed in a raised arrow or pointer shape that is defined by surrounding measurement element apertures 31, as shown in FIGS. 6-9. In addition, in an embodiment not shown in the figures the measurement elements may protrude from the right surface of the blade unit 20, e.g., out of the plane of the page, towards the viewer, when the blade unit is seen from the viewpoint shown in FIG. 3. The measurement elements 30 may have many other shapes, for example raised dots as shown in FIGS. 10-11. In each of these embodiments, the ruled lines 36 can be formed integrally with the housing as raised or recessed hash marks disposed at regular intervals between the measurement elements.

In any of the embodiments shown in FIGS. 2-10, the measurement elements or measurement element apertures may be a different color than the housing. For example, in FIGS. 2-3 the raised rims of measurement element apertures 31 are colored, and in FIGS. 10-11 the raised dots 33 are colored, in each case to enhance identification of the measurement elements and make it easier for the user to see them. Coloring can be accomplished by utilizing pad printing, a technique that is well known in the art, or by other methods such as PVD coating, over-molding or multi-material molding.

Referring to FIGS. 2, 4, 6 and 8, in some embodiments a lubricating/conditioning element 32 is positioned along the trailing edge of the opposite (skin contacting) surface of the blade unit 20 and can be seen through the measurement element apertures 31. Ideally, the lubricating element 32 is colored in such a manner as to highlight the measurement element apertures 31. Additionally, as is well known in the shaving art, the lubricating element 32, when exposed to water, provides a lubricant that is evenly distributed on the skin during shaving.

Figure 12:
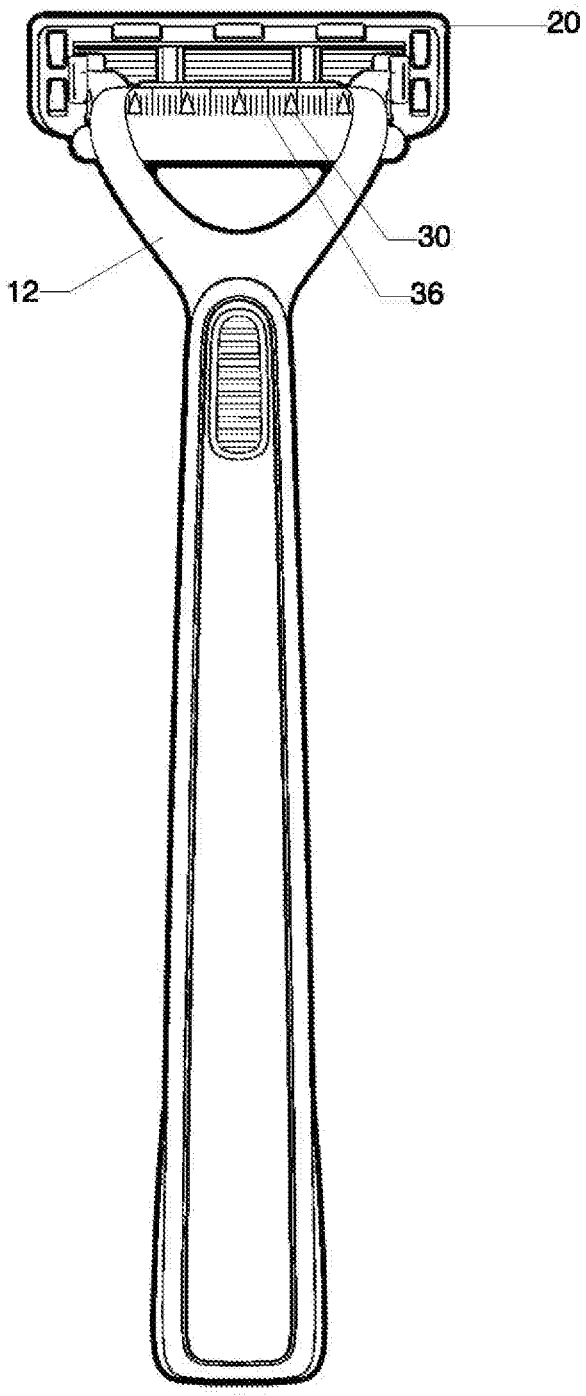
FIG. 12 is a front view of a fifth embodiment.
Figure 13:
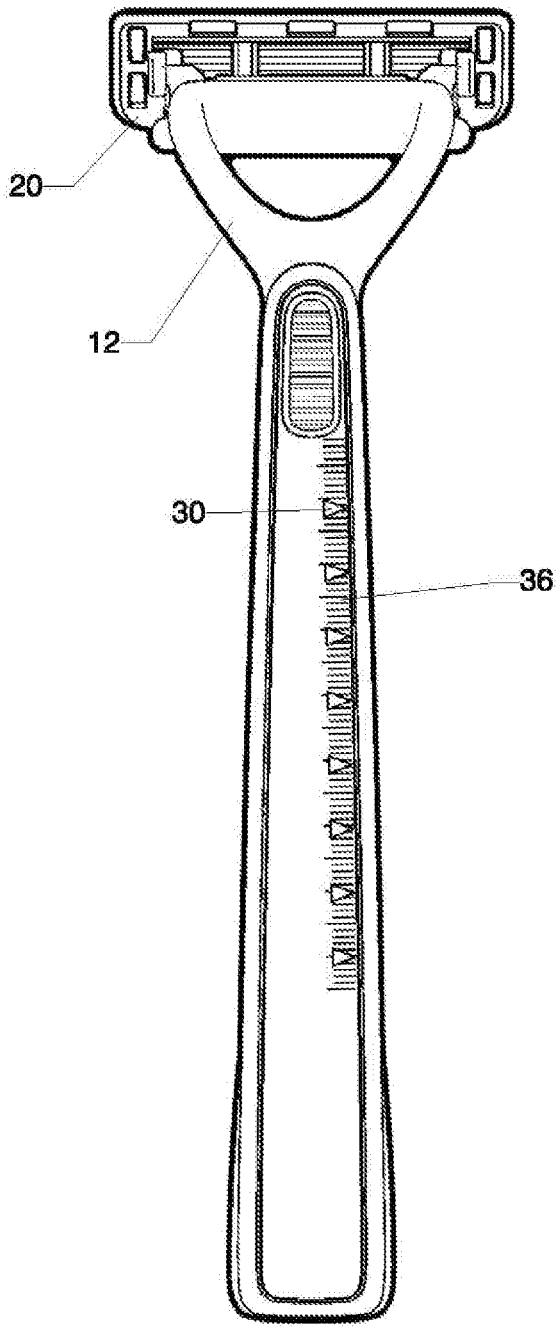
FIG. 13 is a front view of sixth embodiment.

Referring to FIGS. 12 and 13, the measurement elements 30 and ruled lines 36 can be positioned on various aspects of the handle 12 of the shaving device 10, for example along a surface of the handle that is generally parallel to the long axis of the blade unit (FIG. 12), or along the length of the handle (FIG. 13) if a longer row of measurement elements is desired. The measurement elements 30 and ruled lines 36 can be printed, etched, engraved, integrally molded, applied as an adhesive graphic, or other means of attachment. As previously referenced, coloring can be utilized to highlight either or both the measurement elements 30 and the ruled lines 36 thereby uniquely distinguishing them from the other aspects of the handle 12.

In the embodiments shown in the figures, blade unit 20 is removable from handle 12 so that it can be replaced when the blades become dull from use. The handle 12 can be designed to interface with the blade unit 20 in such a manner that would enable easy removal and attachment. This could be accomplished in a number of manners, such as a mechanical locking mechanism, magnetic interaction, etc. For example, the blade unit 20 and handle 12 can interface in the manner discussed in U.S. Ser. No. 61/651,732, filed May 25, 2012, the full disclosure of which is incorporated herein by reference. The interface between the handle and blade unit may include an interface element, e.g., interface element 14 (FIG. 2) which provides a pivoting attachment between the blade unit and handle. Pivoting of the blade unit is about an axis that is generally parallel to the long axis of the blade unit and is generally positioned to allow the blade unit to follow the contours of a user's skin during shaving. Pivoting shaving systems include a mechanism to provide resistance during shaving and return the blade unit to a "rest" position when it is not in contact with the user's skin.

Other, more basic embodiments, (not shown) feature a blade unit that is pivotable, but fixedly attached to the handle, or even integrally formed with the handle in a fixed position. Such embodiments would be less expensive and disposable once the blades became dull from use.

The handle 12 and the housing of blade unit 20 can be made of any suitable substantially rigid material including, for example, polyethylene terephthalate (PET or PETE), high density (HD) PETE, thermoplastic polymer, polypropylene, oriented polypropylene, polyurethane, polyvinyl chloride (PVC), polytetrafluoroethylene (PTFE), polyester, high-gloss polyester, metal, nylon polymer, antibacterial or antimicrobial materials, or any combination thereof.

OTHER EMBODIMENTS

A number of embodiments have been described. Nevertheless, it will be understood that various modifications may be made without departing from the spirit and scope of the disclosure.

For example, in other embodiments the measurement elements can be provided in a variety of colors or alternative shapes.

Additionally, although the measurement elements have been discussed as being raised, they could alternatively be recessed or combinations of raised and recessed features may be used.

Accordingly, other embodiments are within the scope of the following claims.

What is claimed is:

1. A method of shaving comprising providing a shaving system having a blade unit, and a handle on which the blade unit is pivotably mounted, the blade unit comprising a plurality of blades disposed in a housing with the length of each of the blades disposed perpendicular to the length of the handle, the housing having a front cutting side and an opposite rear non-cutting side, and a plurality of measurement elements on a trailing edge of the rear side of the housing, wherein the handle extends from a central portion of the rear non-cutting side of the blade unit, and a lubricating strip disposed adjacent the trailing edge on the front cutting side of the housing, wherein the measurement elements comprise openings positioned facing directly away from the front cutting side so that portions of the lubricating strip are visible through the openings during shaving, and wherein the housing is a first color and the lubricating strip is a second, different color;

utilizing the measurement elements to measure a dimension of a facial hair feature; and contacting the skin with the blades to remove a portion of the facial hair from the skin by shaving, so as to sculpt the outline of the facial hair feature based on the measured dimension.

2. The method of claim 1, wherein the facial hair feature is a sideburn or a portion of a mustache.

3. The method of claim 2, wherein the dimension is width.

4. The method of claim 2, further comprising comparing the dimension of the sideburn or mustache with a corresponding dimension of an opposite sideburn or portion of the mustache.

5. The method of claim 1, wherein the measurement elements are regularly spaced along the trailing edge of the blade unit from a first lateral side of the housing to a second lateral side of the housing.

6. The method of claim 1, wherein the openings are arrow shaped or triangular.

7. The method of claim 1, wherein the blade unit is removably mounted on the handle by an interface element on which the blade unit is pivotably mounted.

* * * * *